United States Patent [19]

Ygfors

[11] 3,974,468

[45] Aug. 10, 1976

[54] CONTACT CARRIERS FOR RELAYS

[76] Inventor: Göran Ygfors, Smastugevagen 10, 162 40 Vallingby, Sweden

[22] Filed: Feb. 3, 1975

[21] Appl. No.: 546,194

[30] Foreign Application Priority Data

Feb. 7, 1974 Sweden ..... 7401634

[52] U.S. Cl. ..... 335/151; 200/267; 200/268; 200/283; 335/154; 335/196

[51] Int. Cl.[2] ..... H01H 1/66; H01H 51/00

[58] Field of Search ..... 200/267, 268, 283; 335/151, 154

[56] References Cited

UNITED STATES PATENTS

| | | | |
|---|---|---|---|
| 3,495,061 | 2/1970 | Coffin et al. | 200/267 |
| 3,497,655 | 2/1970 | Riff | 200/268 X |
| R28,220 | 10/1974 | Ratliff et al. | 335/154 |

*Primary Examiner*—J. D. Miller
*Assistant Examiner*—Fred E. Bell
*Attorney, Agent, or Firm*—Silverman & Cass

[57] ABSTRACT

Contact carriers for relays are produced by electrochemically plating sheets of electrically conductive nonmagnetic metal with iron. The sheets have a width corresponding to the intended length of the contact carriers. The sheets are then cut in strips across the width of the sheets to form the contact carriers. The sheets can be plated on one or both sides. Following the plating step and before cutting the strips from the sheet, the sheet can be mechanically treated, as by rolling, to increase the resiliency of the sheet. The sheet can be masked during the plating operation to produce contact carriers with unplated portions on the plated sides of the carriers. A contact element can be mounted on the plated or unplated portion of the contact carrier and more than one contact element can be mounted on each carrier. The contact carriers and contact elements can be arranged in relays in many combinations utilizing the forces of attraction and repulsion.

14 Claims, 13 Drawing Figures

Fig. 10
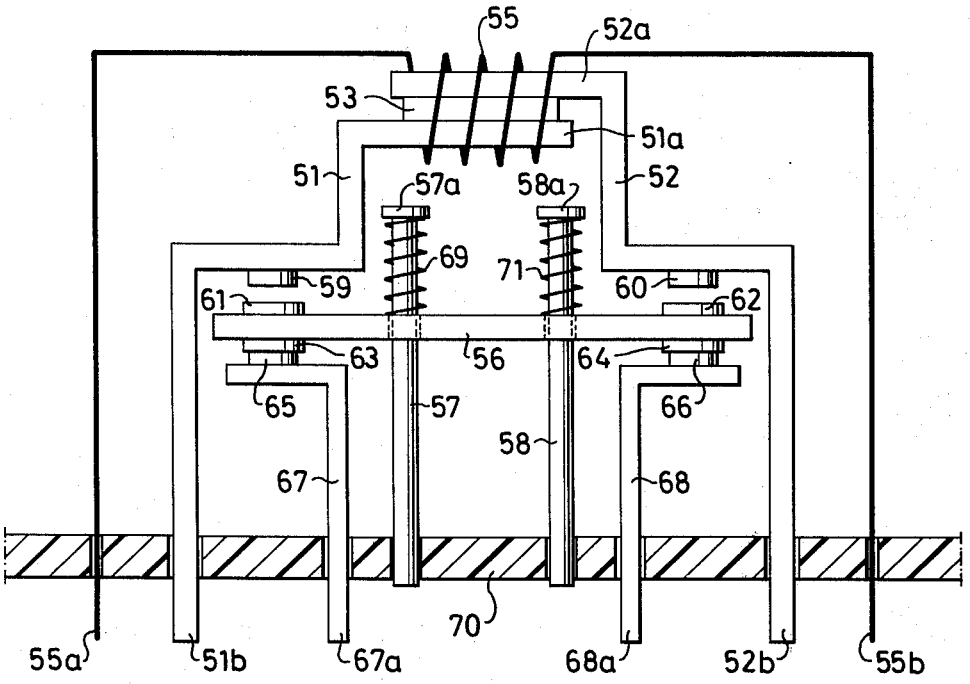
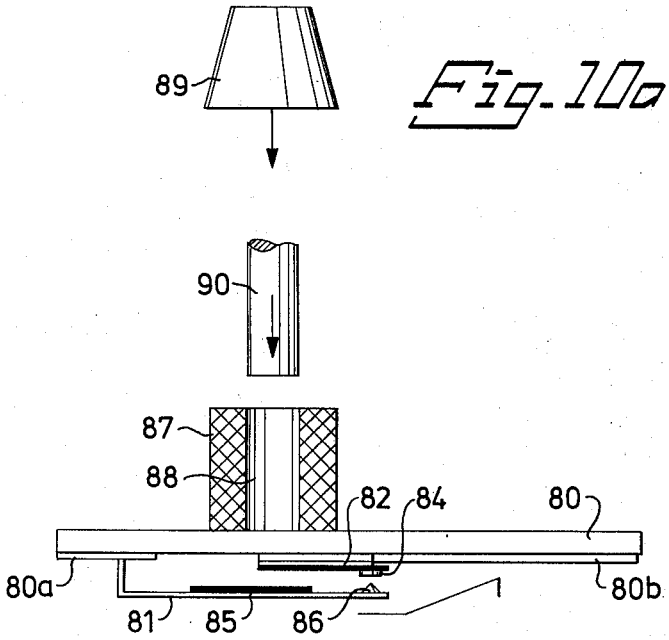
Fig. 10a

CONTACT CARRIERS FOR RELAYS

BACKGROUND OF THE INVENTION

The present invention relates to contact carriers for relays and a method of producing such contact carriers as well as relays in which the contact carriers will be used.

In the majority of cases the contact carriers consist of springs formed as longish spring strips of mainly straight shape, but within the scope of the patent it is intended to include contact carriers in which the resilient capacity of the carriers takes second place and the magnetic properties of these are of greater interest.

One object of the present invention is to produce improvements as regards the construction of so-called reed relays. Such relays usually consist of a tube, which is usually sealed and evacuated or filled with an inert gas and contains spring strips inserted into this from each end of the tube with contact elements facing each other on the respective ends of the two springs, these last-mentioned ends being located at the middle of the tube so that the contact elements are at the said middle. For example, when it is a matter of a making contact, the contact elements (which usually consist of a point on one spring and a pad on the other spring) will be exactly opposite each other and are in the position of rest slightly separated from each other.

The springs consist of magnetic material, usually iron, with a low coercive force and high permeability and they are actuated by a winding arranged around the tube which, when supplied with current, produces magnetization of both springs by means of a magnetic flux which is usually switched on outside the tube by a yoke of magnetic material with low coercive force and high permeability passing between the ends of the tubes and located outside the winding arranged around the tube.

When the winding is supplied with current a magnetic flux will be set up through the springs principally in the lengthwise direction of the tube and the two springs will then be drawn towards each other and close the contacts, so that a circuit, in which the contact springs with pertaining contact elements are included, will likewise be made. By arranging a contact element on one spring located on a part on the other side of the opposing spring, a breaking of a circuit can be produced when the winding is supplied with current. By forming at least parts of the springs of permanently magnetic material and arranging these parts on the respective springs so that they will be brought very close to each other at the movement of the springs towards each other when the winding is supplied with current, it is possible to obtain a closure of the contacts that will remain even after the current feed to the winding has ceased. In such a case breaking is obtained by passing a current of short duration through the winding in the opposite direction.

As reed relays of various types are already well known to specialists in this field, it has been considered that the preceding account will be sufficient to obtain the background to the present invention.

As already stated, it is generally necessary for the said reed relays that the springs are magnetic. Springs of iron have been used for this, but it has been difficult to obtain a suitable compromise between magnetic properties and elastic properties etc. Springs of phosphor bronze with a layer of magnetic material mounted have also been used. Those have presented troublesome production problems and even difficulties as regards the magnetic properties of the said contact carriers in the form of springs made up of different materials.

SUMMARY OF THE INVENTION

Through the present invention a contact carrier has been obtained in which a very clear boundary has been established between the mechanical and electrical properties of the carrier on the one hand and the magnetic properties on the other hand.

The basis for this has been the use of a material for the contact carrier with the mechanical and electrical properties necessary in each individual case and on this material applying a layer of principally pure iron by an electrolytic plating process. It appears that this plating of iron, due to the high degree of purity that the iron will then exhibit, has a very high permeability and very low coercive force and will therefore in a very favourable way meet the requirements placed on magnetic material intended for use in reed relays and similar.

BRIEF DESCRIPTION OF THE DRAWINGS

In order for the invention to be better understood, expedient embodiments of the same will be described in the following in connection with the accompanying drawings.

FIG. 10 shows schematically a relay suitable for mounting on a circuit card and in which a contact carrier according to the invention will be used.

FIG. 10*a* is a cross section of another relay also suitable for mounting on a circuit card.

DESCRIPTION OF THE PREFERRED EMBODIMENTS

In the figures the different layers of material have not been drawn to the relative sizes that will be used in practice, but the intention has been to indicate the general construction in each individual case. The same reference numbers have been used in the different figures to indicate corresponding parts and in certain cases, for the sake of clarity, the numbers are followed by a letter.

Figure 1:
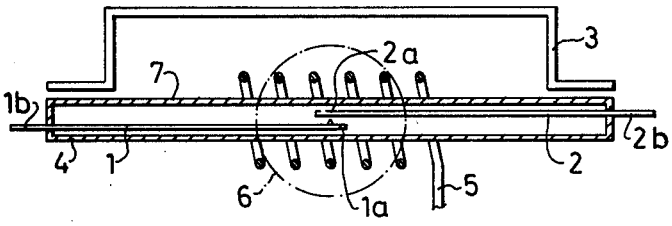
FIG. 1 shows schematically the construction of a reed relay in which contact carriers according to the invention can be used.

FIG. 1 shows the general arrangement of a reed relay. In the tube designated 7 made of non-magnetic and electrically non-conductive material — usually glass — two contact carriers 1 and 2 are fitted, which are resilient and have at their ends 1*a* and 2*a* located approximately at the middle of the tube 7, contact elements, which in the case shown are separated from each other in the position of rest. The ends 1*b* and 2*b* of the contact elements or springs are fused into the ends of the tube and further the tube 7 is surrounded by a winding 5. The ends of the springs at the respective ends of the tube are magnetically connected to a yoke 3 of magnetic material and this yoke extends in the case shown outside the winding 5.

The intention of the construction shown in FIG. 1 is that the springs 1 and 2 being magnetic will attract each other when the winding 5 is supplied with current of sufficient amplitude. The present invention relates to the said contact carriers or springs 1 and 2 and according to the principle of the present invention, these springs 1 and 2 have been formed so that different materials serve to produce resilience and magnetic conductivity. This takes place by iron plating a strip of phosphor bronze or other suitable electrically conductive material intended for resilience on at least part of its surface, this plating being obtained by electrochemical means and usually subjected to a certain mechanical action by rolling, for example, and proves to have a high permeability and low coercive force and thus has the properties desirable for springs included in a reed relay.

On the basis of the stated general principles of the invention, it is possible to form the contact carriers — the springs — in a reed relay fitted with a making contact in different ways without going outside the scope of the invention.

It should be pointed out first that by means of the production method stated further on, a coating can be obtained in the form of iron plating on whichever part or parts of a strip-shaped phosphor bronze spring that is desired. The iron plating can also be given an appreciable thickness in the order of several tenths of a millimetre, i.e. of the same order of size as the phosphor bronze springs used for relays generally have. The thickness of the plating is adapted to the requirements of each individual case and the same applies to the thickness of the phosphor bronze spring.

Figure 2:
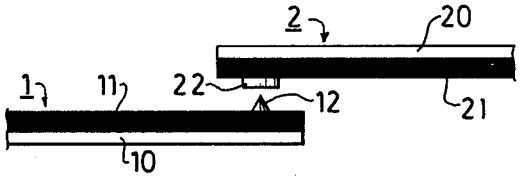
FIGS. 2 - 6 show some different possibilities of forming contact springs for use in reed relays according to the present invention.

Different embodiments as regards the plating will be described in the following and in particular the section located inside the circle 6 will be described. In this connection it can be pointed out that the ends, designated 1*b* and 2*b* in FIG. 1, of the contact carriers 1 and 2 will suitably have no iron plating due to the fusing into the tube. In FIG. 2 the contact carrier 1 is shown to consist of a strip 10 of phosphor bronze and such that the intended resilience is obtained. The contact carrier 2 consists similarly of a strip (20) of phosphor bronze and in the majority of cases of the same dimensions as the strip 10. On the strip 10 there is iron plating of the kind already indicated — i.e. obtained by electrochemical means and possibly after application on the phosphor bronze material subjected to a mechanical treatment in the form of e.g. rolling — and this iron plating is designated 11 in FIG. 2 and the iron platings have also been indicated in FIGS. 2 – 6 by means of shading. At the end of the contact carrier formed in this way and located at the middle of the tube 7 there is a contact element, in the case shown a point contact 12, and the iron plating 11 and the point contact 12 are located on the same side of the phosphor bronze spring 10. Contact carrier 2 is built up in the same way of a phosphor bronze spring 20 and arranged on this is an iron plating 21 of the same kind as the iron plating 11.

At the end of the contact carrier 2 located at the middle of the tube 7 there is a contact element 22, which in this case is in the form of a pad, and the contact element 22 and the iron plating 21 are located on the same side of the phosphor bronze spring 2. The mode of action is the same as that already stated and when current passes through the winding 5 (FIG. 1), not shown in this case, a magnetic circuit will be established through the yoke 3 (FIG. 1), also not shown here, in which the iron platings 11 and 21 on contact carriers 1 and 2, respectively, will attract each other so that the contact elements 12 and 22 located at a short distance from each other in the position of rest will make contact with each other and close the intended circuit. Contact elements 12 and 22 have been formed as a point and pad, respectively, in the usual way and in both cases are provided with a connecting shank part (not shown) which passes through an opening (not shown) in the contact carrier 1 or 2 and is riveted on to the carrier. By selecting the said opening, which extends through both layer 10 and layer 11, with a diameter accurately fitting the said shank part, riveting will provide good electrical contact between contacts 12, 22 and phosphor bronze layers 10, 20, respectively.

Figure 3:
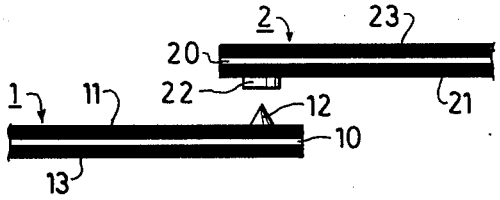

FIG. 3 shows a second embodiment of contact carriers 1 and 2. Here there are phosphor bronze layres 10 and 20, as in FIG. 2, but in this case there are, in addition to the layers of plating 11 and 21 shown in FIG. 2, layers of plating 13 and 23 on the opposite side of phosphor bronze layers 10 and 20 in relation to layers 11 and 21, respectively. As in the previous case, the layers of plating 13 and 23 have also been produced by an electrochemical process and can have a subsequent mechanical treatment in the manner already stated. As a rule it is possible to apply the layers 11 and 13, 21 and 23 at one and the same operation or sequence of operations. The construction shown in FIG. 3 with the layers of plating applied on both sides of each spring can be used in cases where it is desired to obtain such a large total thickness of iron plating that it is difficult to produce this thickness in the form of one layer, but more suitable to produce the desired total thickness by dividing this up into two layers, each of half the total thickness. In other respects what has been stated in connection with FIG. 2 applies also to the construction shown in FIG. 3.

Figure 4:
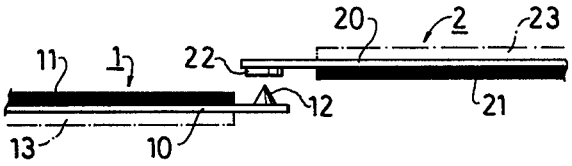

FIG. 4 shows another construction of the contact carriers 1 and 2. In this the ends of the respective carriers located a the middle of the tube 7 consist of only the ends of the respective phosphor bronze springs 10 and 20 and these ends, consisting solely of phosphor bronze, are provided with riveted contact elements 12 and 22. In this case it is possible to obtain good contact connection between the contact elements and the phosphor bronze springs even without particularly accurate fitting of the diameters of the element shanks and the openings in the springs 10 and 20. The layers of iron plating 11 and 21 should extend to points close to the respective contact elements 12 and 20 so the magnetic reluctance will be low. The dotted lines in FIG. 4 indicate a possibility even in this case of supplementing the iron plating 11 and 21 on one side of the phosphor bronze springs 10 and 20 with an additional layer of iron plating designated 13 and 23 located on the opposite side of the spring. Regarding the last-mentioned case, refer to what has been stated in connection with FIG. 3.

Figure 5:
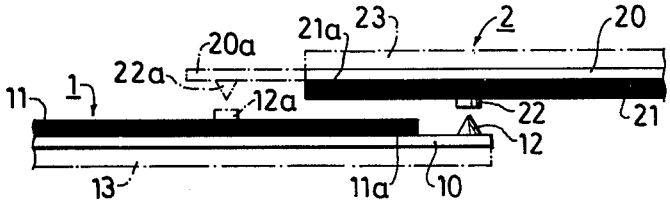

FIG. 5 shows a construction of the contact carriers in a reed relay in the case where a very small reluctance is desired in the magnetic circuit formed when the relay is supplied with current. In the same way as before, there are phosphor bronze springs 10 and 20 for the two contact carriers 1 and 2, respectively. For contact carrier 1 the spring 10 extends outside the layer of iron plating designated 11 in the direction towards the middle of the tube 7 (tube 7, winding 5 and yoke 3 have not been shown in FIGS. 2 – 5) and on the free part of spring 10 there is a contact element 12. The second contact carrier 2 had a phosphor bronze spring 20 and this spring has a layer of iron plating 21 extending to the end of the spring 20. Layers of iron plating 11 and 21 are arranged on such sides of the springs 10 and 20 that the layers of iron plating are always facing each other. On contact carrier 2 there is a contact element 22 arranged exactly opposite and facing the contact element 12, and the contact element 22 will be arranged on the layer of iron plating 21. The end of contact carrier 2 extends beyond the end of the plating layer 11 on the contact carrier 1 and, as is clearly show in FIG. 5, the sections 11*a* and 21*a* coated with iron plating will be located exactly opposite each other and the magnetic reluctance will therefore be very low. Contact elements 12 and 22 must touch each other before the iron-plated sections 11*a* and 21*a* have made contact with each other.

In FIG. 5 the dotted lines indicate that additional layers of iron plating 13 and 23 can be arranged on opposite sides of the respective phosphor bronze spring as for that shown in FIG. 3, also that the spring 20 can be extended beyond the end of the layer of iron plating 21 and the free end thus obtained is provided with an additional contact element 22*a*, which interacts with an additional contact element 12a on the contact carrier 1. Contact elements 12*a* and 22*a* must make contact with each other before the sections 11*a* and 21*a* touch each other. The construction shown in FIG. 5 will produce favourable conditions in the magnetic circuit of the relay.

Figure 6:
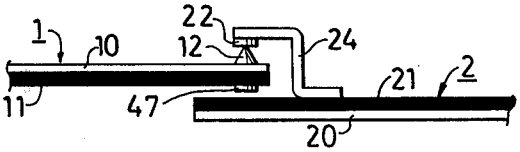

In the embodiments described hitherto it has been a matter of switching on a current when the winding 5 is supplied with current and an attraction has been obtained between the two contact carriers 1 and 2 when the current is applied. However, there is also a possibility of obtaining a breaking function when current is supplied to the winding 5 by arranging the contact elements 12 and 22 as shown in FIG. 6, so that with an attraction between carriers 1 and 2, a breaking function will be obtained by means of the connecting element 24 of electrically conductive material, for example phospor bronze. A disc 47 of insulating material prevents the contact carriers 10 and 20 touching each other when they are attracted. This action is obvious and should not require any further explanation. According to the principle shown in FIG. 6 for obtaining a breaking function at an attraction between two contact carriers, it is possible, regarding the arrangement of the iron platings, to carry out such modifications as for the making function shown in FIGS. 3 – 5.

Use can also be made of the making contacts shown in FIGS. 2 – 5 together with the contact elements shown in FIG. 6 and thereby obtain a switching function, for example.

Figure 7:
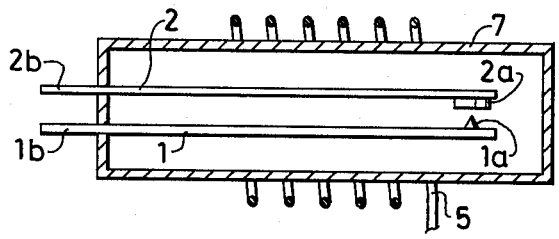
FIG. 7 shows an embodiment of a modified reed relay, in which instead of attraction between a pair of contact carriers formed as springs according to the invention, they are subjected to repulsion forces resulting in a current break.
Figure 8:
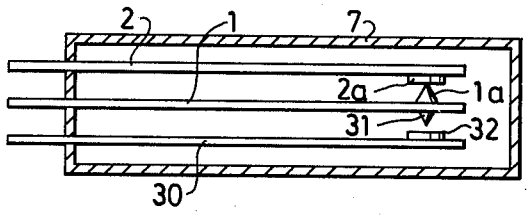
FIG. 8 is a further development of the construction shown in FIG. 6 for obtaining a contact switching.
Figure 9:
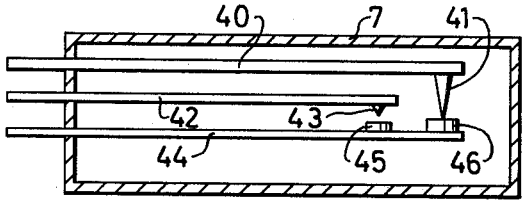
FIG. 9 shows a second further development of the construction shown in FIG. 6 for obtaining a continuous switching.

The contact carriers 1 and 2 can also be arranged in such a way that at a magnetization of the carriers a repulsion will be obtained between them. An example of this is shown in FIG. 7, where a tube 7 is surrounded by a winding 5 and in this tube at one and the same end of the tube there are projecting contact carriers 1 and 2 provided with contact elements 1*a* and 2*a* at the ends located inside the tube. These carriers 1 and 2 have, in the same way as before, a resilient part of phosphor bronze, for example, and a magnetic part in the form of iron plating. The same modifications, as regards the application of iron plating on the phosphor bronze springs, that are indicated in FIGS. 2 – 5 can even be adapted in this case. In FIGS. 7 – 9, contrary to what the circumstances were in FIGS. 2 – 6, a contact carrier comprising a resilient phosphor bronze strip or similar and iron plating applied to this has been indicated by one strip, whilst a carrier bounded by two full lines indicates a contact carrier that has no magnetic conductivity, i.e. in the cases treated iron plating is lacking. The yoke necessary for making the magnetic circuit has not been shown in FIGS. 7 – 9.

FIG. 7 shows the contact carriers 1 and 2 principally parallel to each other and of the same kind as those shown in FIGS. 2 – 5 and fitted with a pair of contact elements 1*a* and 2*a* making contact with each other at the position of rest. With current in winding 5 the carriers 1 and 2 will be magnetized in the same direction so that like poles will be opposite each other, and the contact elements 1*a* and 2*a* are moved away from each other due to the repulsion between carriers 1 and 2 and a breaking function will be obtained.

The repulsion principle shown by means of FIG. 7 can be used to obtain further kinds of contact functions. FIG. 8 shows how a switching function can be obtained. Here the contact carriers are phosphor bronze springs provided with iron plating and these carriers 1 and 2, as in FIG. 7, have a pair of contact elements 1*a* and 2*a* making contact with each other in the position of rest. A third contact carrier 30 is arranged parallel to the carriers 1 and 2, and which is located in the case shown on the opposite side of the carrier 1 to carrier 2. The contact carrier 30 is non-magnetic and has no iron plating and can consist of phosphor bronze only, for example, and form a relatively stiff spring. It is provided with a contact element 32, which is located exactly opposite a further contact element 31 on the contact carrier 1, but in the position of rest does not touch the contact element 31. When current is supplied to winding 5 arranged around the contact carriers but not shown, there will be repulsion between carriers 1 and 2 and carrier 1 will deflect so that contact between contact elements 1*a* and 2*a* ceases, whilst contact is obtained between contact elements 31 and 32. It is apparent that a switching function has been obtained, in which the contact element of carrier 1 has changed over from making contact with carrier 2 to making contact with carrier 30. In this case it is suitable that carrier 2 has a larger spring constant than carrier 1, i.e. contact carrier 2 is a stiffer spring than carrier 1.

FIG. 9 shows how a continuous switching function can be obtained according to the repulsion principle. In this case there is a contact carrier 40 in the tube 7 in the form of a stiff phosphor bronze spring provided with iron plating and formed with a contact element 41. In addition, a second contact carrier 42 is arranged close to carrier 40 and consists of a phosphor bronze spring with iron plating, but in this case the spring is lose stiff than the spring or carrier 40 and forms in actual fact a soft spring. The contact carrier 42 has a contact element 43. Further there is a third contact carrier 44 on the opposite side of carrier 42 to carrier 40. Carrier 44 is completely non-magnetic and can be formed by a phosphor bronze spring without iron plating, it has a weak resilient action and thus forms a soft spring. The carrier 44 also has two contact elements 45 and 46 and the element 45 is arranged to interact with contact element 43 on carrier 42 so that when there is repulsion between carriers 40 and 42 a closing function will be obtained between the elements 43 and 45. The contact element 46 on carrier 44 interacts with the contact element 41 on carrier 40 and the elements 41 and 46 are in contact with each other in the position of rest. This contact will only cease when carrier 42, as a result of current feed to winding 5 (FIG. 7), has been repelled sufficiently for the contact element 43 to move into contact with element 45 on carrier 44 and has deflected the latter so much that the element 46 has moved away from the element 41. Thus a continuous switching will be obtained of a current path to carrier 44 from originally carrier 40 and switching to carrier 42.

It is obvious that within the scope of the invention there are further modifications on reed relays working by attraction and repulsion in addition to those shown, and this will be apparent to specialists in this field and is therefore not described here, but will come within the scope of the invention.

In the types of relays now treated in the form of reed relays it has been the intention that the contact carrier shall exhibit a considerable resilient action combined with electrical conductivity and magnetic properties. The contact carriers formed according to the basic principle of the invention can be used, however, in cases where it is of principal importance that the carriers have electrical conductivity combined with magnetic properties or in the first place magnetic properties.

One example of such an application of a contact carrier according to the invention is shown in FIG. 10. This shown a design of relay suitable for use on circuit cards with printed circuits. FIG. 10 shows to considerably enlarged scale a circuit board 70, which forms the circuit card provided with printed circuits (not shown). Two contact carriers 51 and 52 with the double-angle shape shown have been arranged by insertion in suitable openings in the board 70. The free ends of these carriers above the board 70 each have a section 51*a* and 52*a* principally parallel to the board 70, and these parallel sections are located close together but have no electrical contact with each other due to an intermediate thin layer 53 of electrically insulating material. Both sections 51*a* and 52*a* are surrounded by a winding 55, which is connected to the terminals 55*a* and 55*b* indicated schematically at the back of the board 70. The contact carriers 51 and 52 each have a contact element 59 and 60, respectively, on further sections, which are also principally parallel to the board 70. The carriers 51 and 52 consist of an electrically conductive base in the form of phosphor bronze, for example, and are provided with iron plating on at least one side, the platings being in the first place on the sides of the respective carriers 51 and 52 facing the board 70. The carriers 51 and 52 beyond the angle pass principally at right angles through the board 70 and form terminals 51*b* and 52*b* at the back of the board 70.

Two guide pins 57 and 58 of non-magnetic and possibly also electrically insulating material are also fitted on the board 70. An armature 56, located by means of the guide pins, consists of a contact carrier according to the invention with an electrically conductive but non-magnetic layer and an iron plating on one or both sides of the said layer. The armature 56 is provided on the side turned away from the board — the top side — with a pair of contact elements 61 and 62 located so that the element 61 interacts with element 59 on carrier 51 and element 62 with element 60 on carrier 52. To permit location by means of the guide pins 57 and 58, the armature is provided with suitably positioned through holes. On the other side of the armature — that facing the board 70, the underside — there is a further pair of contact elements 63 and 64 and these are located principally exactly opposite the elements 61 and 62 on the top of the armature and are located exactly opposite elements 65 and 66, respectively, on the angles 67 and 68, respectively, which are secured in suitable openings in the board 70 and on ther other side of the board 70 are formed as terminals 67*a* and 68*a.* Helical springs 69 and 71 are arranged on the said guide pins between the heads 57*a* and 58*a* and tie armature 56 and keep the armature 56 in a position such that, when the winding 55 is not being supplied with current the contacts 63 and 64 of the armature will be in contact with contacts 65 and 66, respectively, on angles 67 and 68, respectively. In the position of rest — no current feed to winding 55 — a current path will be obtained between the terminals 67*a* and 68*a.*

However, when the winding 55 is supplied with current of sufficient intensity, due to the design of the carriers 51 and 52 with both an electrically conductive layer and iron plating, attraction will be obtained of the armature 56 formed in the same way. contact 61 will then move into contact with contact 59 on carrier 51 and contact 62 will move into contact with contact 60 on carrier 52 and a closed circuit will be formed between terminals 51*b* and 52*b,* and thus in this case a switching function will be obtained. Due to the insulating layer 53, already mentioned, the contact carriers will not form any closed circuit in other cases.

FIG. 10*a* is a cross section of another relay also suitable for mounting on a circuit card. The card is designated elements of the circuit on the card. A springing relay strip 81 of an unmagnetical material is fastened to the element 80*a.* Said strip carries a contact at 86. An iron plating 85 is located on the spring 81. The circuit element 80*b* is provided with an iron plating 82 and a contact 84. On the other side of the circuit card there is a solenoid 87 having a core of soft iron 88 or there is a push button arrangememt comprising a button 89 connected to a permanent magnet 90 which is kept at a certain distance from the circuit card by a spring (not shown).

When the solenoid is fed with current the soft iron core 88 is magnetized, the plating 82 will be magnetized, whereby the plating 81 will be attracted to the plating 82, which will cause contact to be made between the two relay contacts 84, 86. If the device is provided with a push button 89, when the button is pushed, the permanent magnet 90 will be pressed down on the circuit card, whereby the iron plating 82 will be magnetized, so that the iron plating 81 will be attracted and the contacts 84, 86 will close.

A relay of the type now described can be of very small size and, by the use of contact carriers according to the invention, can be adapted particularly well to be built up on circuit cards of simple parts which can easily be mass produced.

In the present description in conjunction with the different embodiments, phosphor bronze springs were generally mentioned, as these are very common in relay engineering. It should be pointed out, however, that the phosphor bronze material can be replaced by any other material that in electrically conductive and has suitable resilient properties. On the other hand the iron plating produced by electrochemical means and principally of pure iron is specific for the invention and contributes to a decisive degree to the good results obtained and which depend on high permeability and low coercive force of the iron platings of the kind intended.

Figure 11:
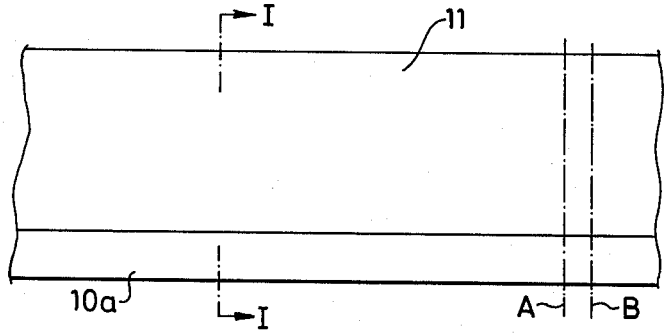
FIG. 11 is a plan view.
Figure 12:
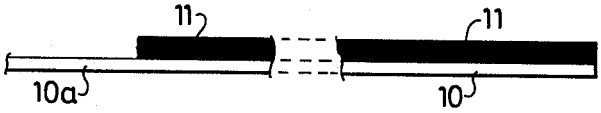
FIG. 12 a sectional elevation of a blank suitable for the production of the contact carriers used in FIG. 2.

In conjunction with FIGS. 11 and 12, it should be pointed out that a contact carrier of the kind designated 10 in FIG. 2 can be produced in a simple way by cutting along the chain-dotted lines A and B of the blank shown in FIGS. 11 and 12. This is a strip of resilient material, for example, phosphor bronze sheet, with the thickness in question and a width across the strip corresponding to the length of a contact carrier with pertaining terminal lug. The part intended for the terminal lug has been designated 10*a* in FIGS. 11 and 12 and by suitable masking with enamel or similar, it can be arranged that the part of the strip designated 10*a* at the electrochemical application of iron plating does not receive any iron plating, but that the unmasked part of the strip will obtain the iron plating designated 11 in FIGS. 11 and 12. To be suitable for the different constructions previously described, the iron plating can be applied on one or both sides of the strip, and maskings to produce areas free from iron plating such as that designated 10*a* in FIGS. 11 and 12 can be arranged so that several areas free from iron plating are obtained on one or both sides of the strip. By cutting at right angles to the lengthwise direction of the strip in a manner indicated by the chain dotted lines A and B in FIG. 11, the desired contact carriers will be obtained for the intended constructions in each case. When it is a matter of producing contact springs for reed relays, the base for receiving the iron plating must obviously have very good resilient properties. On the other hand for a relay according to FIG. 10 the base can practically lack resilient properties altogether, but should suitably have good conductivity for electric current.

The iron plating produced by electrochemical means will obtain considerably better properties for the intended use by being subjected to a suitable mechanical treatment in the form of rolling or similar in order to compress the iron plating, whereby the same will obtain better mechanical, electrical and magnetic properties.

What is claimed and desired to be secured by Letters Patent of the United States is:

1. A contact carrier in strip form for electric relays, for example of reed relay type, comprising, a layer of electrically conductive nonmagnetic metal, said layer having iron plating on at least a substantial part of its surface on at least one side thereof, said plating being produced by electrochemical means and being composed mainly of pure iron with high permeability and low coercive force.

2. A contact carrier as claimed in claim 1 in which the layer of electrically conductive nonmagnetic metal has iron plating on a continuous area, said area being a substantial part of one side of the layer.

3. A contact carrier as claimed in claim 1 in which the layer of electrically conductive nonmagnetic metal has iron platings on both sides of the layer.

4. A contact carrier as claimed in claim 1 in which the layer of electrically conductive nonmagnetic metal has said plating on multiple areas of said side, said areas being separated from each other.

5. A contact carrier as claimed in claim 1 in which contact elements are arranged in areas of the contact carriers that are provided with iron plating.

6. A contact carrier as claimed in claim 1 in which contact elements are arranged in areas of the contact carrier that are composed solely of the layer consisting of electrically conductive nonmagnetic metal.

7. A contact carrier as claimed in claim 1 in which the iron plating has a thickness of the same order of size as the layer of electrically conductive nonmagnetic metal.

8. A contact carrier as claimed in claim 1 in which the layer of electrically conductive nonmagnetic metal exhibits a considerable resilient capacity which has received a mechanical treatment resulting in said resilient capacity.

9. A method of manufacturing contact carriers comprising the steps of:

forming a strip from a sheet of electrically conductive metal with a width corresponding to the intended length of the contact carriers;

iron plating by electrical chemical means at least one side of said strip in the form of at least one zone running in a lengthwise direction of said strip, leaving one or more zones free from iron plating; and cutting said contact carriers from the strip by means of cuts running straight across the strip principally at right angles to the lengthwise direction of said strip.

10. A method as claimed in claim 9 in which:

said free zones are masked prior to the electrochemical application of the iron plating.

11. A method as claimed in claim 9 in which:

said strip is subjected to a mechanical treatment in order to compress the iron plating following said electrochemical application.

12. A method as claimed in claim 9 in which:

said strip is subjected to a heat treatment following said electrochemical application.

13. A reed relay comprising:

a hollow body;

at least two contact carriers inserted into said body in a spaced apart relationship, each of said contact carriers comprising a layer of electrically conductive nonmagnetic metal, said layer having iron plating on at least a substantial part of its surface on at least one side thereof, said plating being produced by electrochemical means and being composed mainly of pure iron with high permeability and low coercive force; and contact means on each of said carriers for making contact between said carriers.

14. A relay for placing on a circuit board or circuit card comprising:

shanks bent at right angles from each other, electrically insulated from each other and each provided with a terminal section supported by a circuit board;

said shanks each provided with at least one contact element;

an armature arranged for magnetic interaction with sections of said shanks, said armature having a first contact element arranged exactly opposite one of said shank contact elements and said armature having a second contact element arranged exactly opposite the other one of said shank contact elements for interaction between said contact elements;

winding means for magnetizing said shanks attracting said armature and thereby producing contact between said respective contact elements on the shanks and armature;

said shanks and said armature being composed of a layer of electrically conductive nonmagnetic metal, said layer having iron plating on at least a substantial part of its surface on at least one side thereof, said plating being produced by electromechanical means and being composed mainly of pure iron with high permeability and low coercive force.

* * * * *